United States Patent [19]

Hidding

[11] 4,354,609

[45] Oct. 19, 1982

[54] SNAP-ON TAMPERPROOF BOTTLE CAP

[76] Inventor: Walter E. Hidding, Rte. No. 2, Wood Rock Rd., Barrington Hills, Ill. 60010

[21] Appl. No.: 110,648

[22] Filed: Jan. 9, 1980

[51] Int. Cl.[3] ..... B65D 41/34

[52] U.S. Cl. ..... 215/252; 215/318; 215/320; 215/329; 215/354

[58] Field of Search ..... 215/252, 318, 320, 354, 215/329

[56] References Cited

U.S. PATENT DOCUMENTS

| | | | |
|---|---|---|---|
| 1,690,781 | 11/1928 | Genese | 215/320 |
| 2,487,400 | 11/1949 | Tupper | 215/354 X |
| 2,833,324 | 5/1958 | Burroughs | 215/320 X |
| 3,223,269 | 12/1965 | Williams | 215/318 |
| 3,239,090 | 3/1966 | Bramming | 215/354 X |
| 3,484,016 | 12/1969 | Turner . | |
| 3,540,612 | 11/1970 | Brady | 215/354 X |
| 3,858,742 | 1/1975 | Grussen | 215/320 X |
| 3,874,540 | 4/1975 | Hidding | 215/252 |
| 3,902,621 | 9/1975 | Hidding | 215/252 |
| 3,997,077 | 12/1976 | Mill | 215/354 X |
| 4,066,181 | 1/1978 | Robinson et al. . | |
| 4,066,182 | 1/1978 | Allen et al. . | |

FOREIGN PATENT DOCUMENTS

| | | |
|---|---|---|
| 1393366 | 2/1965 | France . |
| 640128 | 7/1950 | United Kingdom . |

*Primary Examiner*—Donald F. Norton
*Attorney, Agent, or Firm*—John S. Fosse

[57] ABSTRACT

A tamperproof closure for a bottle or other container having a neck portion with an external rib comprises a cap body of flexible, resilient material. This cap body includes an annular rim and a pair of skirts depending respectively from the inboard and outboard edges of this rim. The outboard skirt is provided with an internal rib that is adapted for lockable coaction with the bottle neck rib; and a circular top panel is connected to the inboard skirt to cooperate with the inboard skirt in defining a recess for receiving a cap-mounting tool. In accordance with the invention, the rim and its connection with the skirts cooperate to define a resilient hinge section.

4 Claims, 4 Drawing Figures

SNAP-ON TAMPERPROOF BOTTLE CAP

BACKGROUND OF THE INVENTION

This invention relates generally to bottle closures and more particularly to bottle caps which provide a visible display upon having been tampered with after bottle filling and before reaching the ultimate consumer.

One common style of prior art bottle cap of the tamperproof type is fabricated with an internal thread for reversably engaging the externally threaded neck finish of a bottle and with an internally ratcheted, tamper-indicating ring that is breakably connected to the cap proper. This style of tamperproof cap affords ease of reclosure by means of the cooperating threaded structures after the tamperproof ring has been removed.

Another style of prior art tamperproof cap has no threads but rather snaps over a shoulder on the bottle neck finish. This second style of cap is simple to affix during the bottle-filling operation but does not provide a dependable seal because of dimensional variations in the shoulder on the bottle neck. In addition, this second style of tamperproof cap is not particularly convenient to use by the consumer in the resealing mode.

Therefore, an important object of the present invention is to provide a tamperproof cap which is easy to affix to a bottle and which, at the same time, achieves both a highly efficient seal and facility in reclosure.

A more general object of the present invention is to provide a new and improved bottle cap of the tamperproof type.

Another general object of the invention is to provide a closure which may be affixed to a bottle in either the mode of a threaded cap or that of a snap-on cap.

These and other objects and features of the invention will become more apparent from a consideration of the following descriptions.

BRIEF DESCRIPTION OF THE DRAWING

In order that the principle of the invention may be readily understood, a single embodiment thereof, applied to a tamperproof cap but to which the application is not to be restricted, is shown in the accompanying drawing wherein.

DETAILED DESCRIPTION OF THE ILLUSTRATED EMBODIMENT

Figure 1:
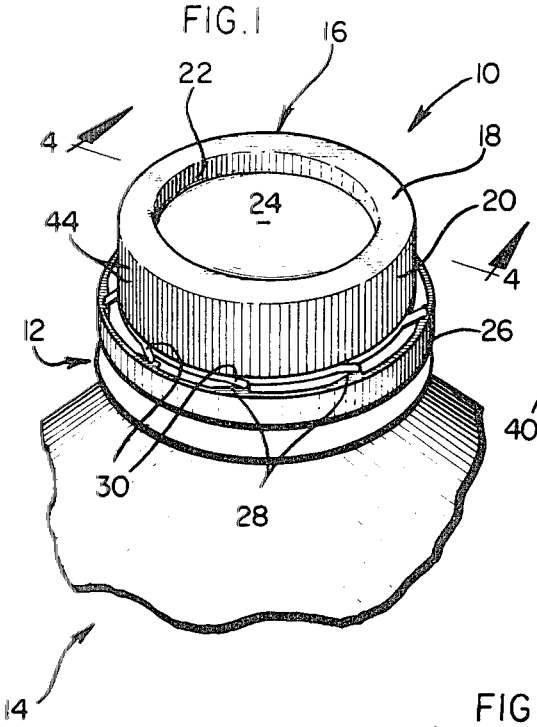
FIG. 1 is a perspective view of a bottle with a tamperproof cap according to the invention affixed thereto.

Referring now in detail to the drawing, specifically to FIG. 1, a tamperproof closure 10, which is constructed in accordance with the present invention, is shown attached to the neck finish 12 of a bottle that is indicated generally by the reference numeral 14. When the bottle 14 is to be employed for packaging liquid milk products, for example, it is conveniently manufactured by blow molding. Continuing with reference to FIG. 1 and with additional reference to FIG. 2, the closure 10 comprises a cap body 16; and the cap body 16 includes an annular rim 18, a first annular outboard skirt 20, a second annular inboard skirt 22 and a generally circular top panel 24. In addition to the cap body 16, the closure 10 includes a tamperproof ring 26, having a plurality of radially inwardly extending, triangular ratchet teeth 28, and a plurality of breakable connectors 30 which couple the tamperproof ring 26 to the cap body 16.

In accordance with the present invention, the top panel 24 of cap body 16 is confluently attached to the lower edge of the inboard skirt 22 which, in turn, is confluently affixed to the inner edge of the annular rim 18. Similarly, the outer edge of rim 22 is confluently coupled to the upper edge of outboard skirt 20. Thus, the top panel 24 and the inboard skirt 22 define a circular recess 32 for receiving a cap mounting tool 34, as is suggested in FIG. 3. In addition and in compliance with the features of the present invention, the cap body 16 is fabricated of a flexible, resilient material, such as polyethylene resin, and the rim 18 and its connections with the skirts 20 and 22 cooperate to define a resilient hinge section for purposes to be described more fully hereinafter. In order to promote the resilient flexing of the top panel 24 and the resilient action of this hinge section, the top panel is fashioned with a relatively thick central section 36 and a relatively thin peripheral section 38 adjacent the juncture between the top panel and the inboard skirt 22. Furthermore, the top panel 24 is advantageously molded in a dome-shape as is well shown in FIG. 2.

Figure 2:
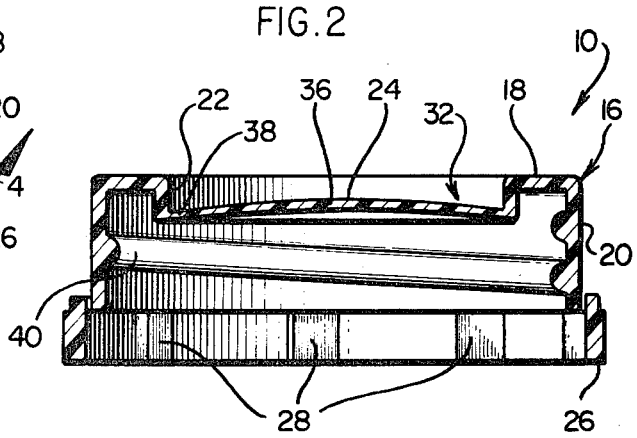
FIG. 2 is an enlarged, central cross-sectional view of the tamperproof cap of FIG. 1.

Continuing with reference to FIG. 2, the outboard skirt 20 is seen to be fashioned with an internal, spiral rib or thread 40. Cooperatively, the neck finish 12 of the bottle 14 is provided with a radially outwardly extending, spiral rib or thread 42. Accordingly, if desired, the closure 10 may be turned onto the neck finish of the bottle 14; and for this purpose, the outer skirt 20 is provided with a plurality of external, vertically extending, grippable ribs 44; and in order to lock the tamperproof ring 26 of closure 10 in place on the bottle 14, the neck finish of the bottle includes at least one external pawl 46 spaced beneath the thread 42 to engage lockably with the ratchet teeth 28 on ring 26 in a first direction of rotation that is associated with unthreading of the closure from the bottle. Hence, once the closure is in place, reverse turning of the closure transmits rotative force from the closure to the engaged pawl and ratchet teeth. When sufficient force is imposed, the connectors 30 are fractured and the ring 26 drops from the closure to afford an indication of tampering.

Figure 3:
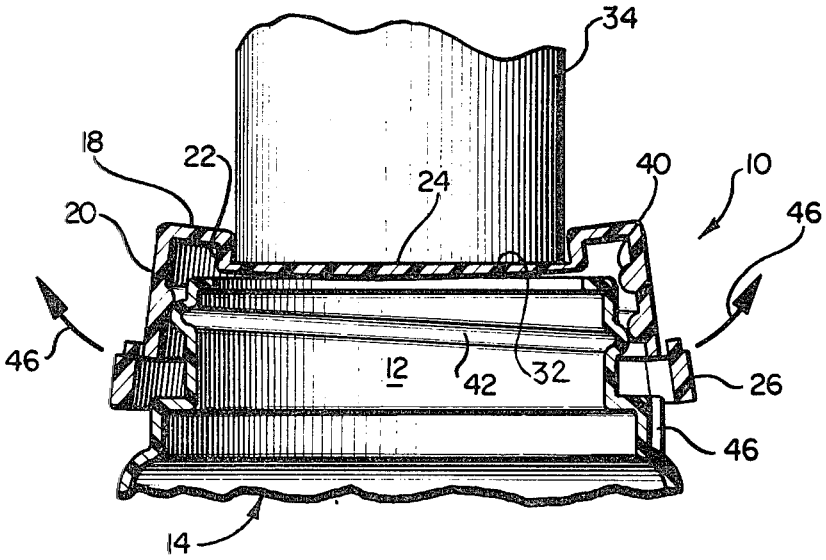
FIG. 3 is a central cross-sectional view showing the mounting of the tamperproof cap of the invention onto a bottle neck finish in the snap-on mode.

In accordance with the features of the present invention, the closure 10 may be affixed to the bottle neck finish in a snap-on action as well as by the turning action described immediately hereinabove. With particular reference to FIG. 3 it will be seen that downward, cap-mounting pressure applied to the top panel 24 by the tool 34 depresses the dome shape of the top panel 24 and causes a downward flexing of the inner edge of rim 18. This action results in a radially outward expansion of the lower edge of outboard skirt 20 and tamperproof ring 26 in the general directions indicated by the arrows 46. This radial enlargement allows the tamperproof ring 26 to pass freely over the pawls 46 and the internal thread 40 of the cap body to pass over the external thread 42 on the neck finish. This flexing action is promoted by the hinge section developed by the rim 18 and the skirts 20 and 22 and by the flattening of the dome-shape of top panel 24. As will be appreciated, flattening of the dome-shape is facilitated by the relatively thin section 38 at the periphery of the top panel.

Figure 4:
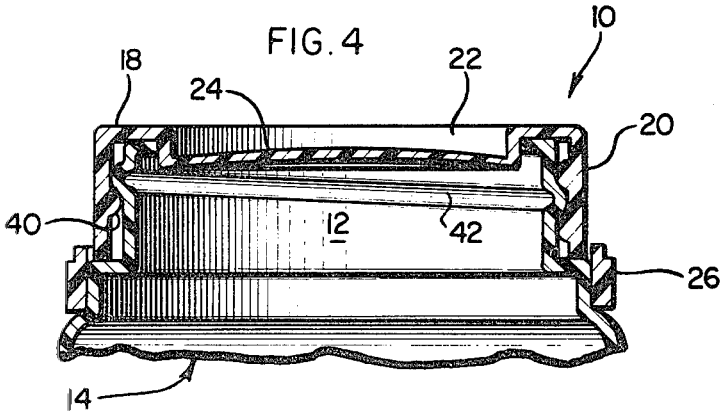
FIG. 4 is an enlarged, cross-sectional view taken substantially along the line 4—4 of FIG. 1 illustrating the cap in place on the bottle neck finish.

Upon withdrawal of the cap-mounting tool 34, the plastic memory of the various parts of the closure 10 cause it to return to its as-molded condition and a seating of the closure on the top of the panel 14 as is shown in FIG. 4. Slight rotation of the closure may be necessary in some circumstances in order to achieve optimum fitted engagement and optimum sealing efficiency. It will be noted that the top, flanged edge of the neck finish fits tightly against the under surface of rim 18 and the inner skirt 22 resides in contact with this bottle neck edge whereby to establish, in effect, a double seal.

While a particular embodiment of the invention has been shown and described, it should be understood, of course, that the invention is not limited thereto since many modifications may be made; and it is, therefore, contemplated to cover by the present application any such modifications as fall within the true spirit and scope of the appended claims.

The invention is claimed as follows:

1. A closure for a bottle or other container having a neck portion with an external rib, said closure comprising: a cap body of flexible, resilient material, including an annular rim, a first annular outboard skirt depending from the outer edge of said rim and having an internal rib adapted for lockable coaction with the bottle neck rib, a second annular inboard skirt of lesser depth than said outboard skirt depending from the inner edge of said rim, and a dome-shaped circular top panel connected to said inboard skirt, said top panel and said inboard skirt defining a recess for receiving a cap-mounting tool and said rim and its connection with said skirts cooperating to define resilient, peripheral hinge section means for producing an outward flexing of said outboard skirt and resultant, substantially straight-line movement of said cap rib over said bottle neck rib and into locking engagement therewith upon the imposition of downward, cap-mounting pressure on said top panel by a said tool.

2. A closure according to claim 1 wherein said cap rib and said bottle neck rib are cooperating spiral threads.

3. A closure according to claim 1 wherein said top panel has a relatively thick central section and a relatively thin peripheral section whereby to promote resilient flexing of said panel and resilient action of said hinge section.

4. A tamperproof closure for a bottle or other container having a neck portion with an external rib and at least one external pawl spaced from said rib, said closure comprising: a cap body of flexible, resilient material, including an annular rim, a first annular outboard skirt depending from the outer edge of said rim and having a internal rib adapted for lockable coaction with the bottle neck rib, a second annular inboard skirt of lesser depth than said outboard skirt depending from the inner edge of said rim, and a dome-shaped circular top panel connected to said inboard skirt, said top panel and said inboard skirt defining a recess for receiving a cap-mounting tool and said rim and its connection with said skirts cooperating to define a resilient, peripheral hinge section means for producing an outward flexing of said outboard skirt and resultant movement of said cap rib over said bottle neck rib and into locking engagement therewith upon the imposition of downward, cap-mounting pressure on said top panel by a said tool; a tamperproof ring having a plurality of radially inwardly extending ratchet teeth for locking engagement with said bottle neck pawl in a first direction of rotation; and a plurality of breakable connectors coupling said tamperproof ring to the outboard skirt of said cap body.

* * * * *